US010069262B2

(12) United States Patent
Little

(10) Patent No.: US 10,069,262 B2
(45) Date of Patent: Sep. 4, 2018

(54) RECEPTACLE CONNECTOR HAVING INSERT MOLDED LEAD-FRAME WAFERS EACH WITH UPPER CONTACTS TRANSVERSELY OFFSET FROM LOWER CONTACTS

(71) Applicant: FOXCONN INTERCONNECT TECHNOLOGY LIMITED, Grand Cayman (KY)

(72) Inventor: Terrance F. Little, Fullerton, CA (US)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/588,717

(22) Filed: May 8, 2017

(65) Prior Publication Data

US 2017/0324202 A1 Nov. 9, 2017

Related U.S. Application Data

(60) Provisional application No. 62/333,161, filed on May 7, 2016.

(51) Int. Cl.
*H01R 27/00* (2006.01)
*H01R 24/60* (2011.01)
(Continued)

(52) U.S. Cl.
CPC ..... *H01R 27/00* (2013.01); *H01R 12/721* (2013.01); *H01R 13/514* (2013.01); *H01R 24/60* (2013.01); *H01R 2107/00* (2013.01)

(58) Field of Classification Search
CPC .. H01R 12/721; H01R 12/722; H01R 12/724; H01R 12/727; H01R 13/514; H01R 24/60; H01R 27/00
(Continued)

(56) References Cited

U.S. PATENT DOCUMENTS 7,674,133 B2 3/2010 Tyco
8,292,669 B2 * 10/2012 Wang ..... H01R 13/514 439/607.2
(Continued)

OTHER PUBLICATIONS

QDFP-DD Specification for QSFP Double Density 8X Pluggable Transceiver Rev 0.1 Mar. 8, 2016.

*Primary Examiner* — Harshad C Patel
(74) *Attorney, Agent, or Firm* — Wei Te Chung; Ming Chieh Chang

(57) ABSTRACT

A receptacle connector for two types of plug includes an insulative housing defining a front mating port and a rear connecting port along the front-to-back direction, the front mating port defining a plurality of upper passageways and a plurality of lower passageways with a receiving slot therebetween in the vertical direction, the upper passageways being respectively offset from the corresponding lower passageways in a transverse direction. An IMLA (Insert Molded Lead-Frame Assembly) assembled within a space of the rear connecting port and including a plurality of wafers stacked with one another along the transverse direction, each of said wafers including an insulator equipped with a front upper contact disposed in the corresponding upper passageway, a rear upper contact located behind the corresponding upper passageway, a front lower contact disposed in the corresponding lower passageway, and a rear lower contact located behind the corresponding lower passageway.

20 Claims, 21 Drawing Sheets

(51) Int. Cl.
*H01R 12/72* (2011.01)
*H01R 13/514* (2006.01)
*H01R 107/00* (2006.01)

(58) Field of Classification Search
USPC ..... 439/638, 637, 630, 639, 50, 53, 55, 65, 439/68, 79, 80, 81, 493, 545, 547, 554, 439/60, 7.32, 43, 49, 52, 151, 166, 171, 439/174, 640
See application file for complete search history.

(56) References Cited

U.S. PATENT DOCUMENTS 8,353,707 B2 1/2013 Hon Hai
8,556,662 B2 * 10/2013 Wang ..... H01R 12/721 439/325
8,727,793 B2 5/2014 Cisco
8,740,644 B2 * 6/2014 Long ..... G02B 6/0001 439/541.5
8,747,158 B2 6/2014 Tyco
8,858,237 B2 * 10/2014 Hsu ..... H01R 13/514 439/60
8,944,830 B2 2/2015 Hon Hai
8,992,237 B2 3/2015 Molex
9,209,538 B2 * 12/2015 Yoshida ..... H01R 12/714
2006/0014438 A1 * 1/2006 Regnier ..... H01R 13/41 439/637
2006/0189212 A1 * 8/2006 Avery ..... H01R 12/724 439/607.05
2006/0216969 A1 * 9/2006 Bright ..... H01R 23/688 439/79
2007/0232091 A1 10/2007 Finisar
2008/0268702 A1 * 10/2008 Little ..... H01R 12/79 439/541.5
2009/0011643 A1 * 1/2009 Amleshi ..... H01R 13/514 439/607.05
2010/0233910 A1 * 9/2010 Zhang ..... H01R 12/712 439/626

* cited by examiner

RECEPTACLE CONNECTOR HAVING INSERT MOLDED LEAD-FRAME WAFERS EACH WITH UPPER CONTACTS TRANSVERSELY OFFSET FROM LOWER CONTACTS

BACKGROUND OF THE INVENTION

1. Field of the Invention

The invention relates to electrical connectors, and particularly to the hybrid type QSFP (Quad Small Form-factor Pluggable) including the Legacy QSFP 28 and QSFP-DD (QSFP Double Density) interfaces.

2. Description of Related Art

For the QSFP connector, the trend leads to the two rows arrangement on the memory card (of the plug connector) with the QSFP-DD in an outer row and the Legacy QSFP 28 in the inner row. The corresponding receptacle is required to be rearranged corresponding to such a hybrid type QSFP. U.S. Publication No. US20070232091, published to Liu on Oct. 4, 2007, discloses a receptacle connector mated with a plug connector. The receptacle connector comprises a body, a row of upper front contacts, received in the body, a row of rear upper contacts disposed behind the upper front contacts, a row of lower front contacts received in the body, and a row of lower rear contacts disposed behind the lower front contacts. The plug connector comprises a printed circuit board for being inserted into the body and mating with the four rows of contacts. The four of the contacts of each column of the four row contacts are difficult to be molded in a common insulative frame that will increase the assembling steps.

An improved electrical connector is desired to offer advantages over the related art.

SUMMARY OF THE INVENTION

An object of the present invention is to provide a receptacle connector having improved insert molded lead-frame assembly.

To achieve the above-mentioned object, Accordingly, the object of the present invention is to provide a plug connector having a mating port equipped with a printed circuit board with two rows of mating pads in a front region wherein the pads in the outer/front row belong to QSFP-DD while those in the inner/rear row belong to Legacy QSFP 28. Correspondingly, the receptacle connector includes an insulative housing forming a front mating port and a rear connecting port wherein the front mating port forms a horizontal slot to receive the printed circuit board of the plug connector and a plurality of upper passageways and a plurality of lower passageways located by two sides of the slot in the vertical direction. An IMLA (Insert Molded Lead-Frame Assembly) is assembled within the rear connecting port and includes a plurality of front and rear upper contacts and a plurality of front and rear lower contacts wherein the front upper contacts are disposed in the corresponding upper passageways, respectively, and the front lower contacts are disposed in the corresponding lower passageways, respectively, so as to mate with the pads in the inner row of the printed circuit board on one hand. On the other hand, the rear upper contacts and the rear lower contacts mate with the corresponding pads in the outer row of the printed circuit board which are exposed behind the slot in the front-to-back direction. The housing forms a recess to receive a front engaging section of the IMLA to retain the IMLA in the housing in a stable manner. The IMLA includes a plurality of wafers stacked with one another along the transverse direction wherein each wafer includes an insulator with a set of contacts including one front upper contact, one rear upper contact, one front lower contact and one rear lower contact, and both the front and rear upper contacts are offset from both the front and rear lower contacts in the transverse direction, whereby the lower passageway and the corresponding upper passageways are not aligned with each other in the vertical direction but being offset from each other with one-half pitch of the upper/lower passageways. Each wafer is equipped with opposite key structure and groove structures so as to restrict relative movement between the neighboring two wafers after stacked with each other. Notably, in the receptacle connector either single deck or double-deck is similar except in the double-deck arrangement, a dissipation space is formed in the housing between the upper mating port and the lower mating port in the vertical direction.

Other objects, advantages and novel features of the invention will become more apparent from the following detailed description when taken in conjunction with the accompanying drawings.

DETAILED DESCRIPTION OF THE PREFERRED EMBODIMENT

Figure 1:
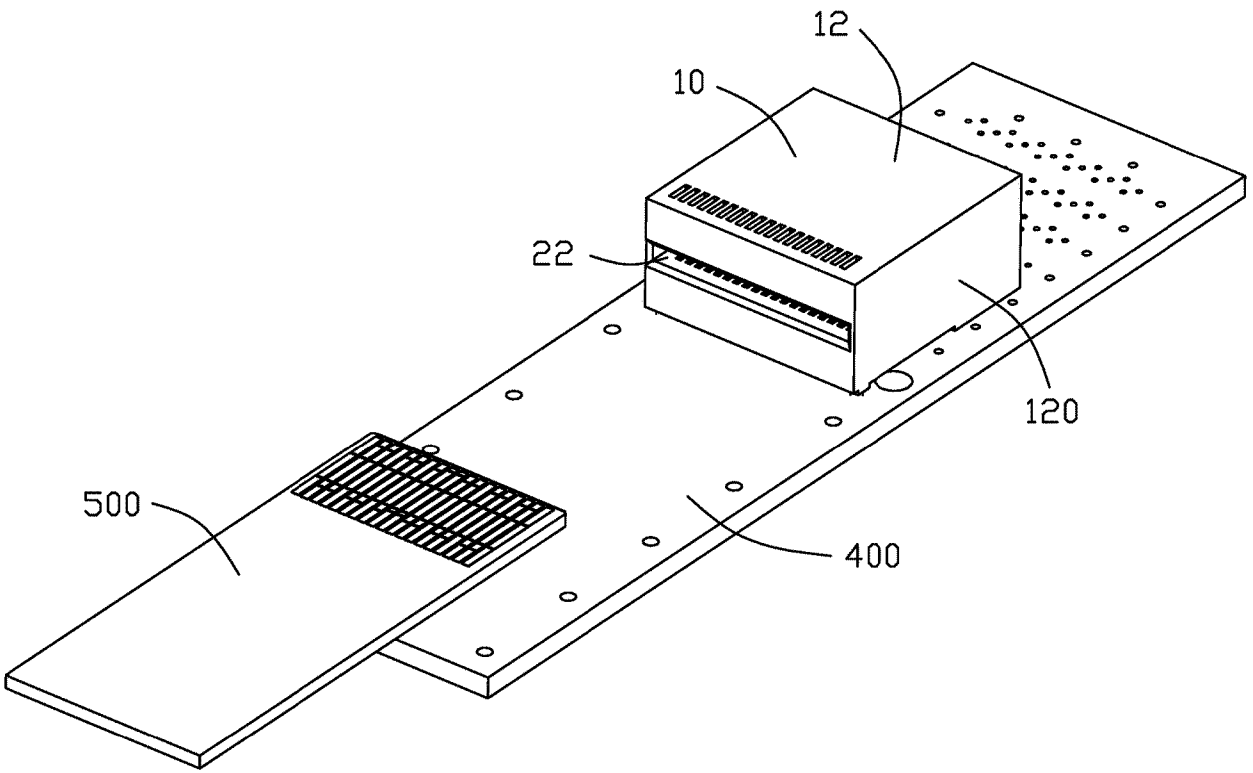
FIG. 1 is a perspective view showing a printed circuit board of a plug connector adapted to be mated with a receptacle connector mounted upon a printed circuit board, according to a first preferred embodiment, i.e., the single deck type, of the invention related to QSFP.
Figure 2:
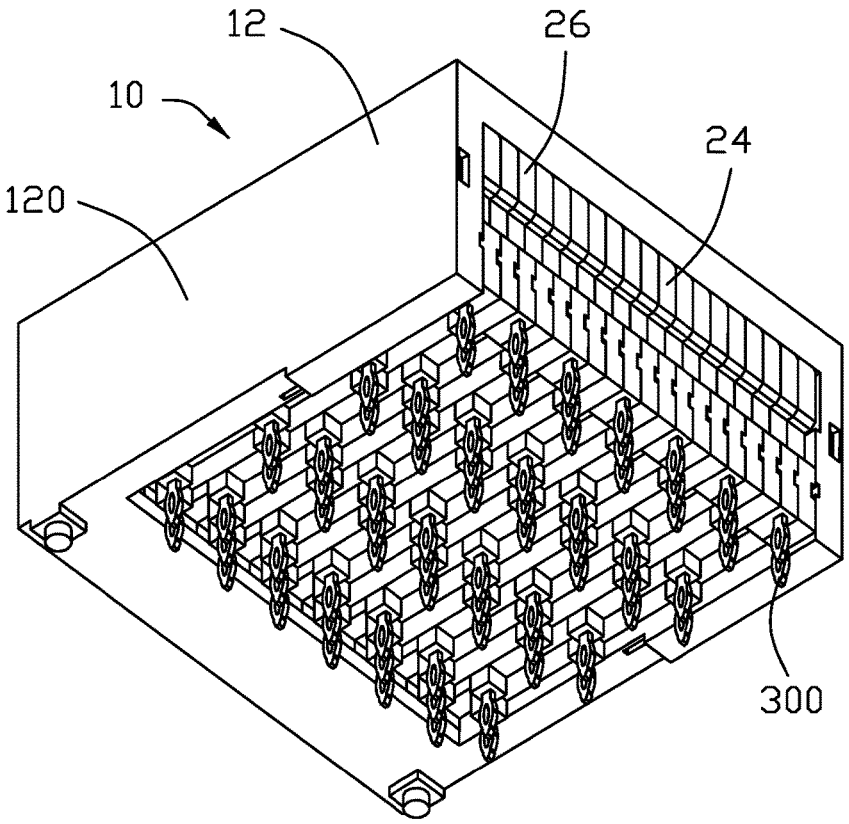
FIG. 2 is an upward bottom perspective view of the receptacle connector in FIG. 1.
Figure 3:
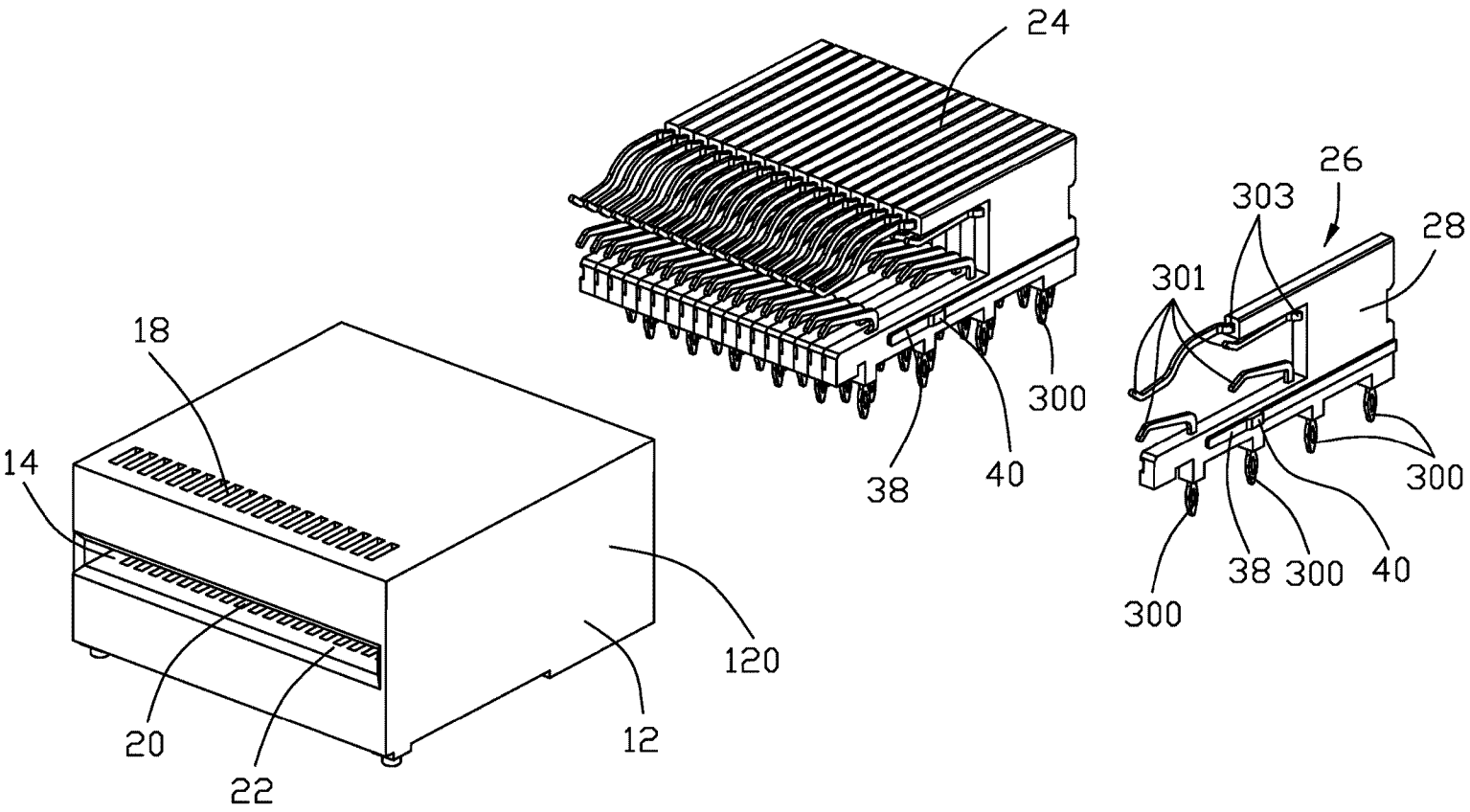
FIG. 3 is a front exploded perspective view of the receptacle connector of FIG. 2.
Figure 4:
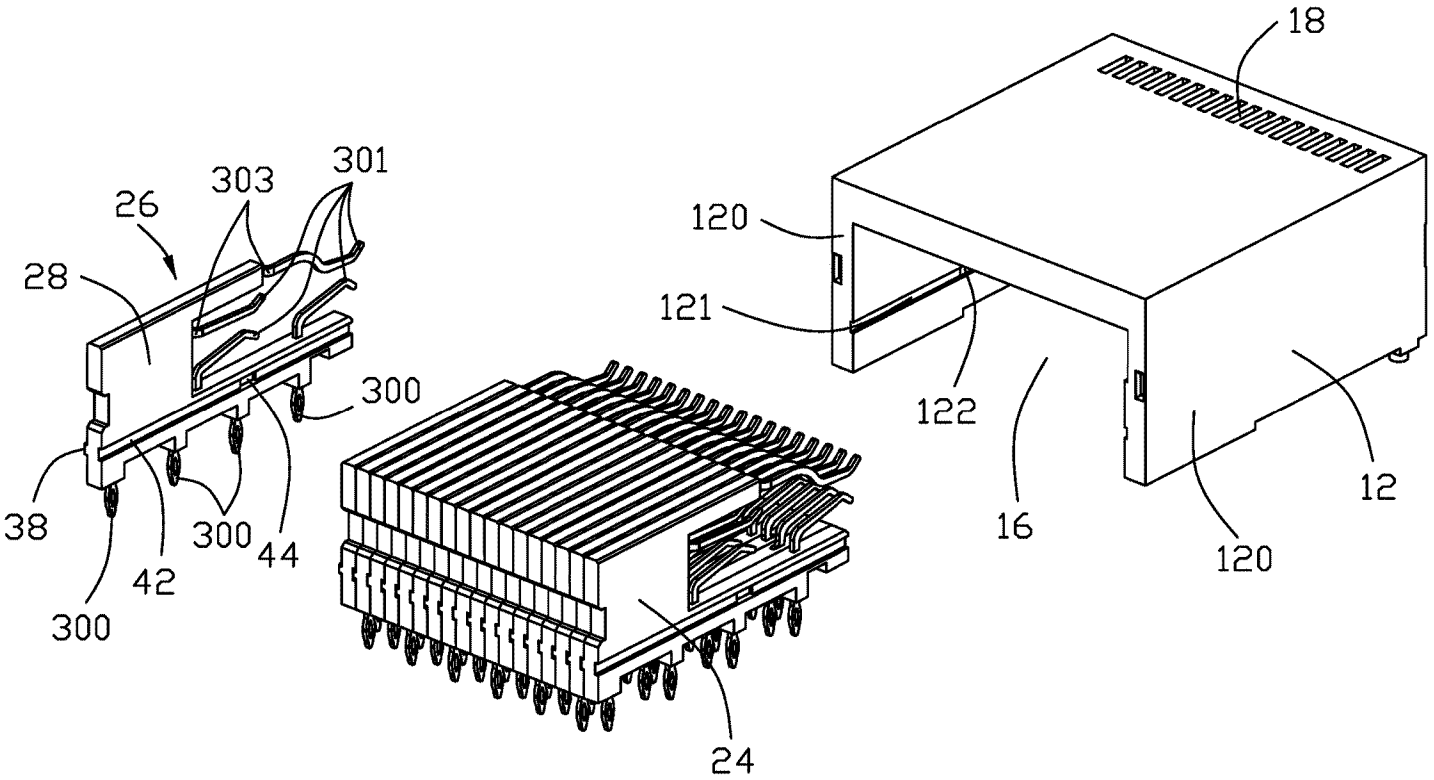
FIG. 4 is rear exploded perspective view of the receptacle connector of FIG. 3.
Figure 5:
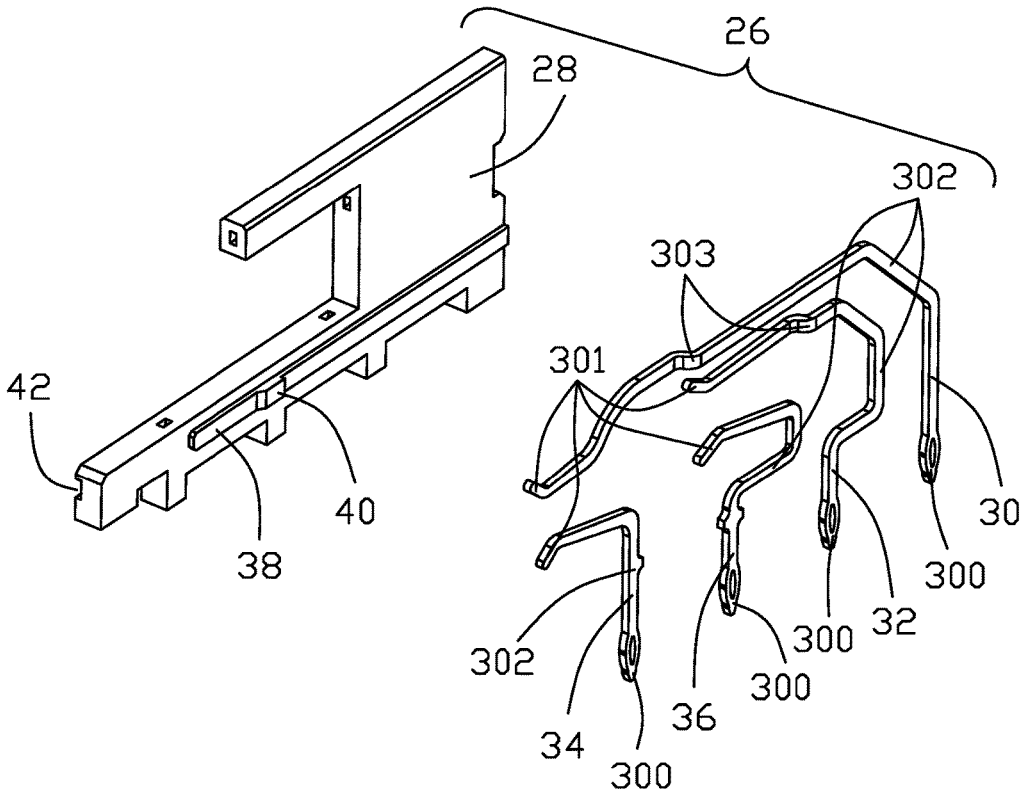
FIG. 5 is an exploded perspective view of the wafer of the receptacle connector of FIG. 3.
Figure 6:
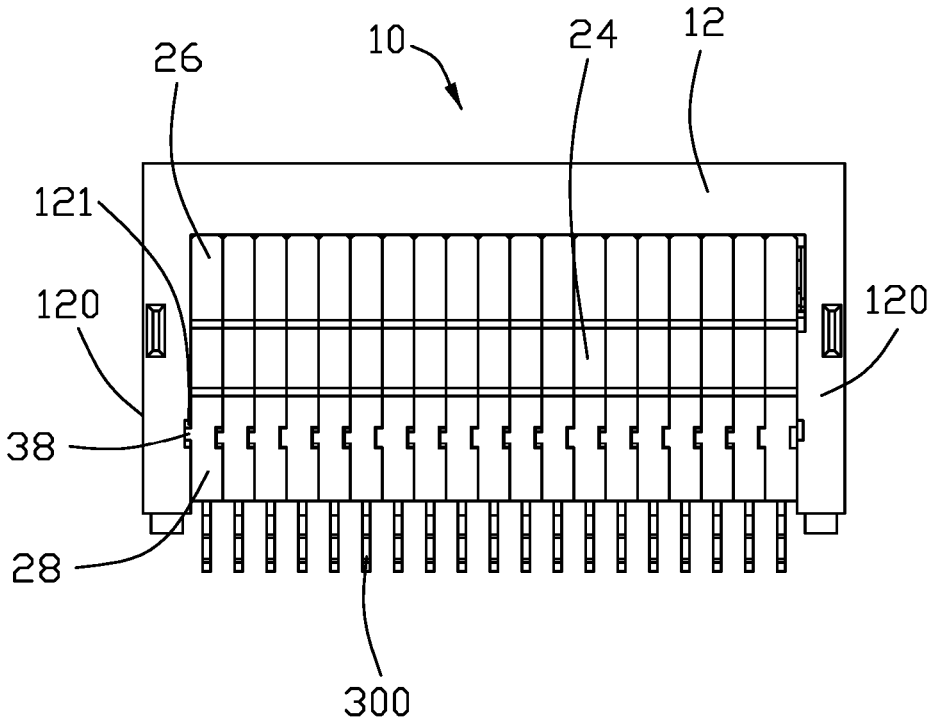
FIG. 6 is a rear view of the receptacle connector of FIG. 2.
Figure 7:
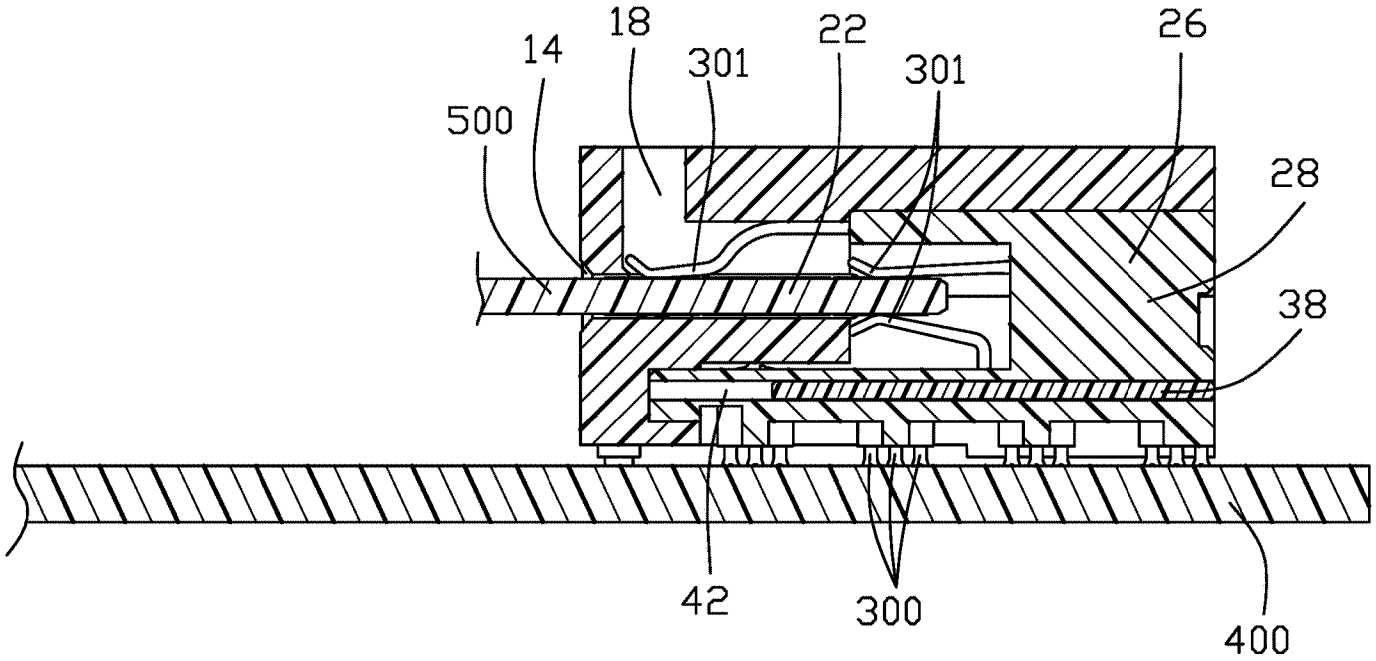
FIG. 7 is a cross-sectional view of the receptacle connector of FIG. 1 mated with the printed circuit board.
Figure 8:
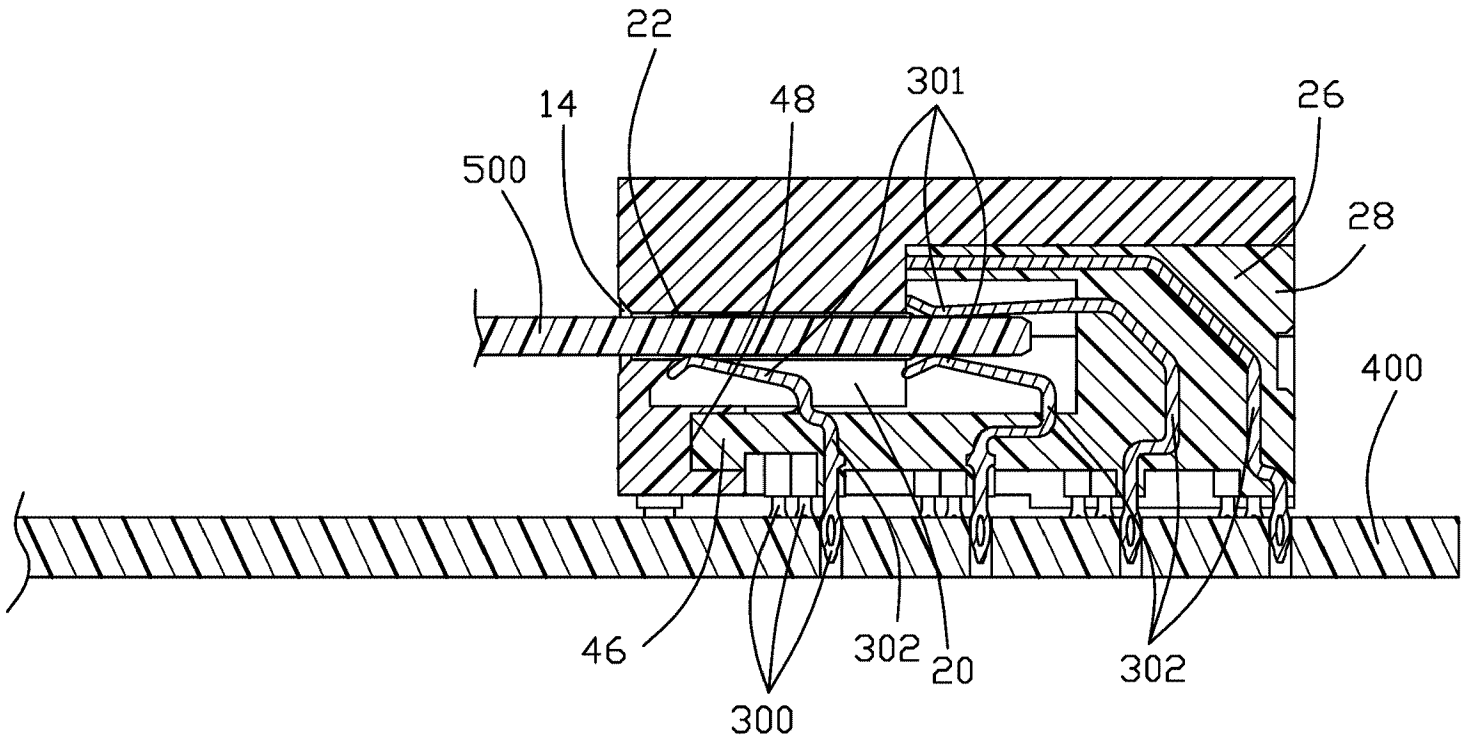
FIG. 8 is another cross-sectional view of the receptacle connector of FIG. 1 mated with the printed circuit board.
Figure 9:
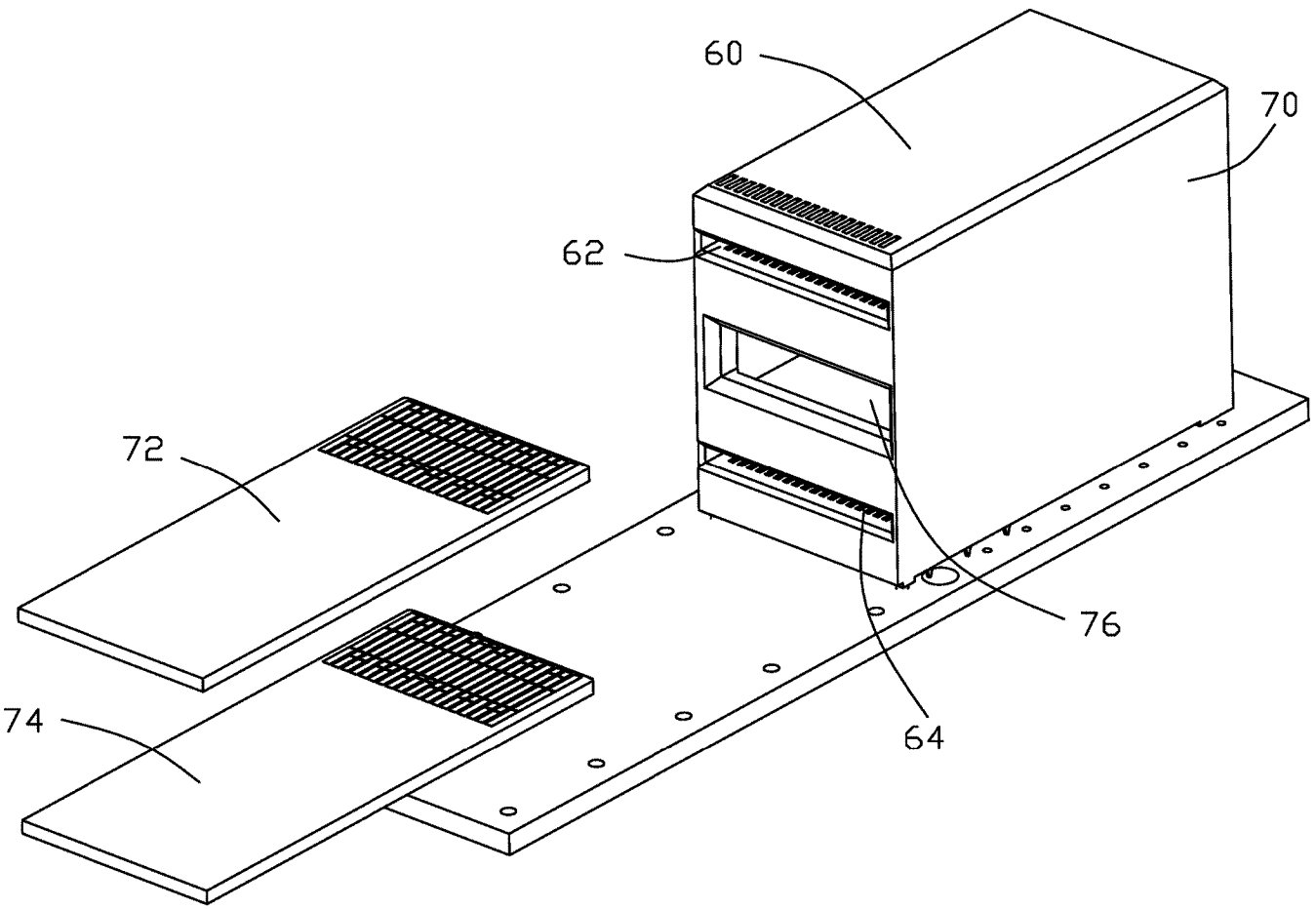
FIG. 9 is a perspective view showing two printed circuit board of one or two plug connector(s) adapted to be mated with a receptacle connector mounted upon a printed circuit board, according to a second preferred embodiment, i.e., the double-deck type, of the invention related to QSFP.
Figure 10:
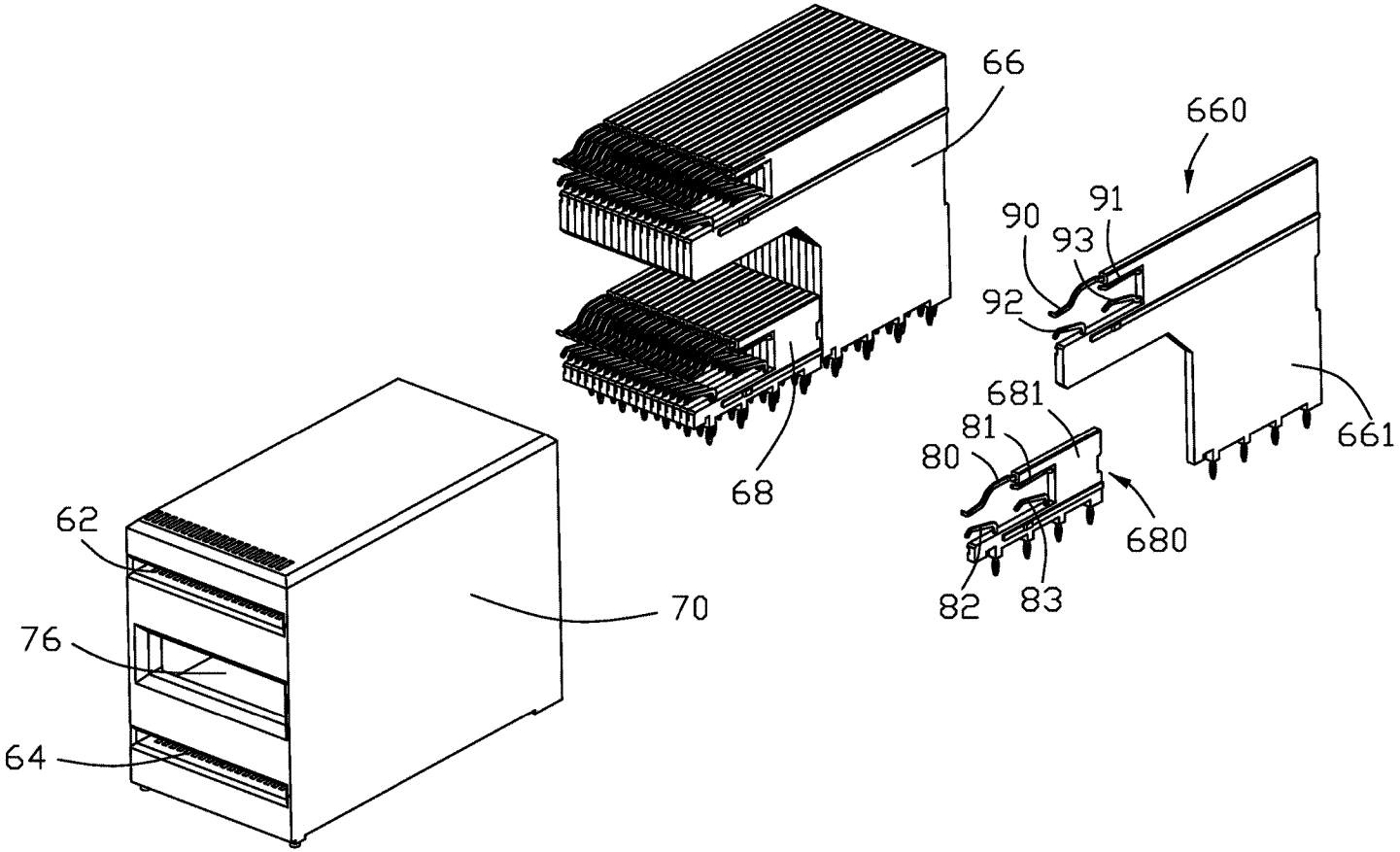
FIG. 10 is a front exploded perspective view of the receptacle connector of FIG. 9.
Figure 11:
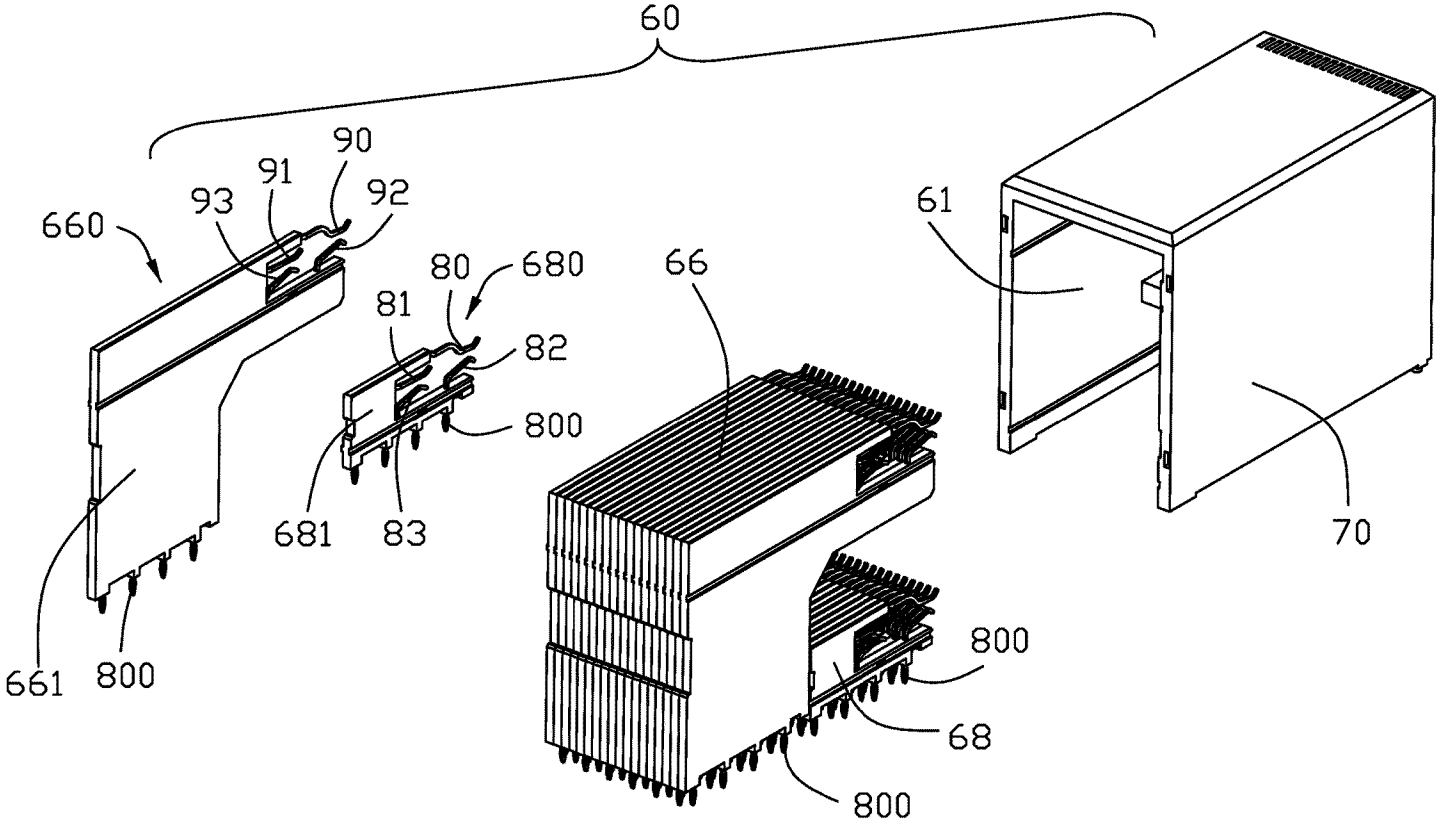
FIG. 11 is a rear exploded perspective view of the receptacle connector of FIG. 10.
Figure 12:
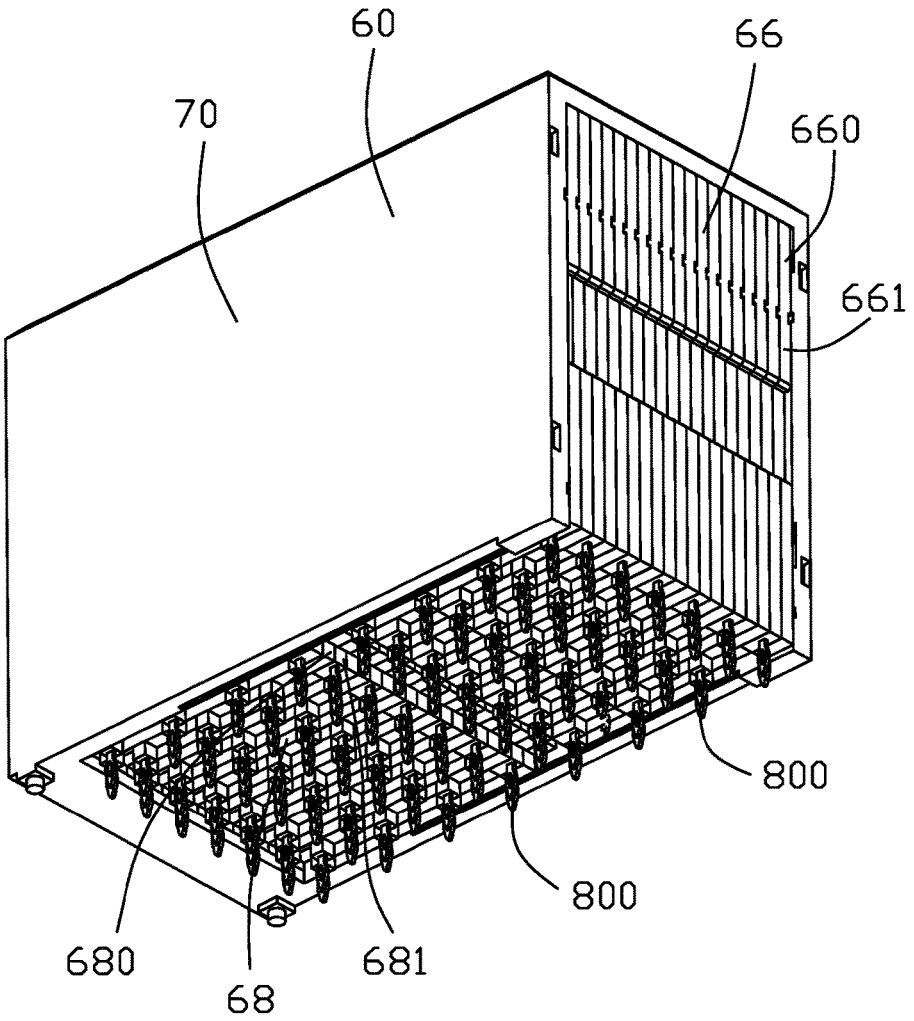
FIG. 12 is an upward rear perspective view of the receptacle connector of FIG. 19.
Figure 13:
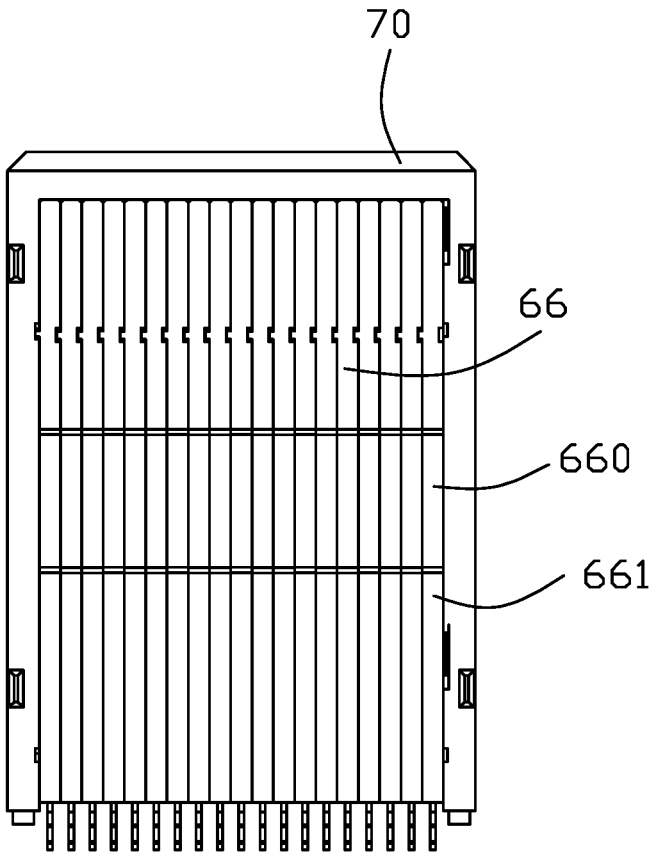
FIG. 13 is a rear view of the receptacle connector of FIG. 9.
Figure 14:
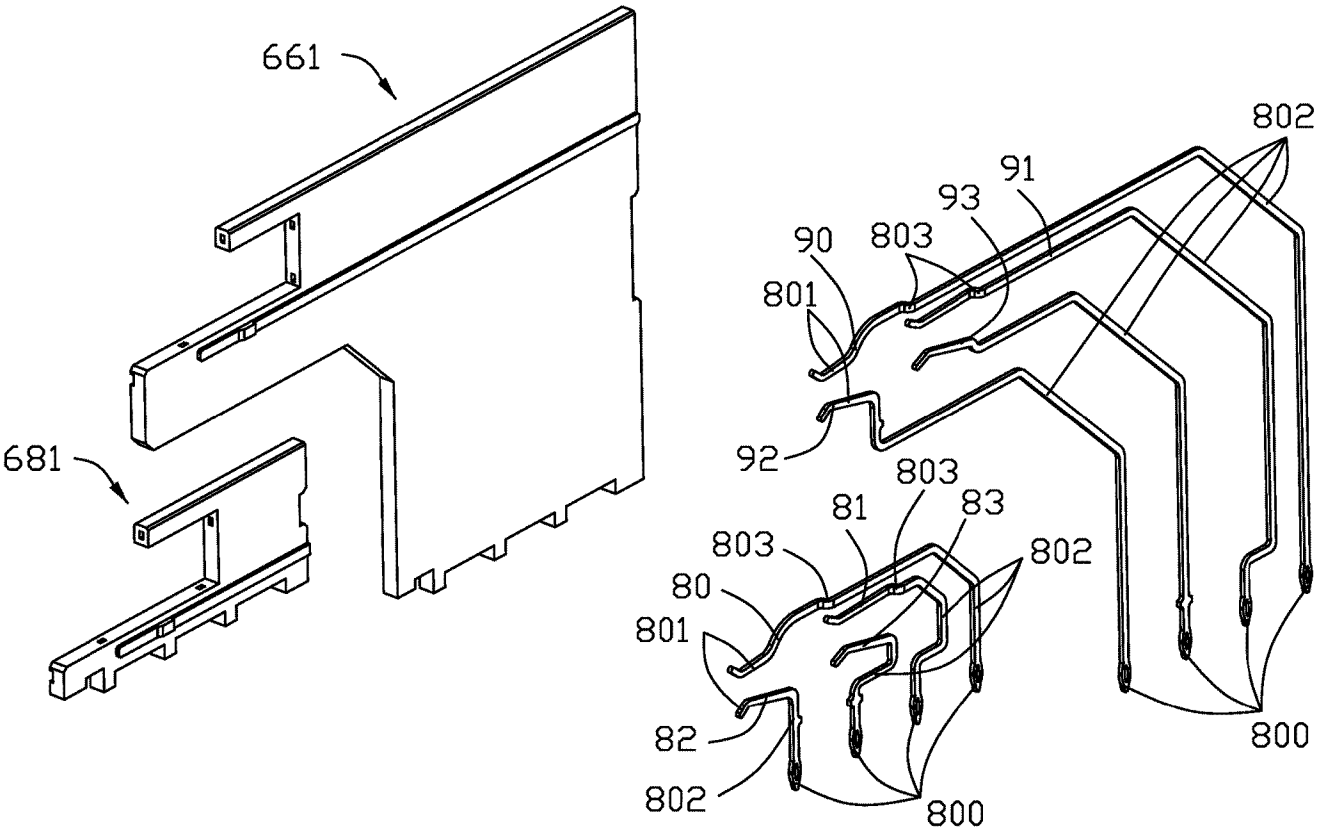
FIG. 14 is an exploded perspective view of the upper wafer and the lower wafer.
Figure 15:
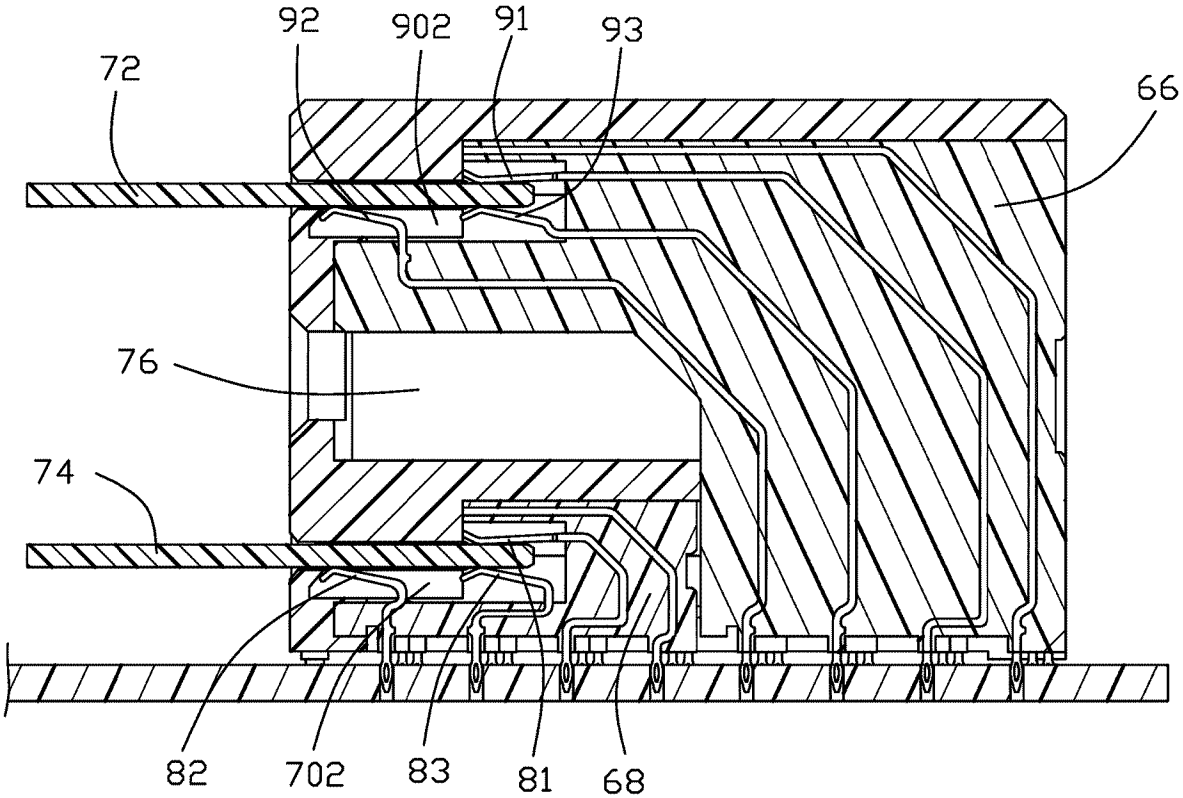
FIG. 15 is a cross-sectional view of the receptacle connector of FIG. 9 wherein the printed circuit boards are mated therewith.
Figure 16:
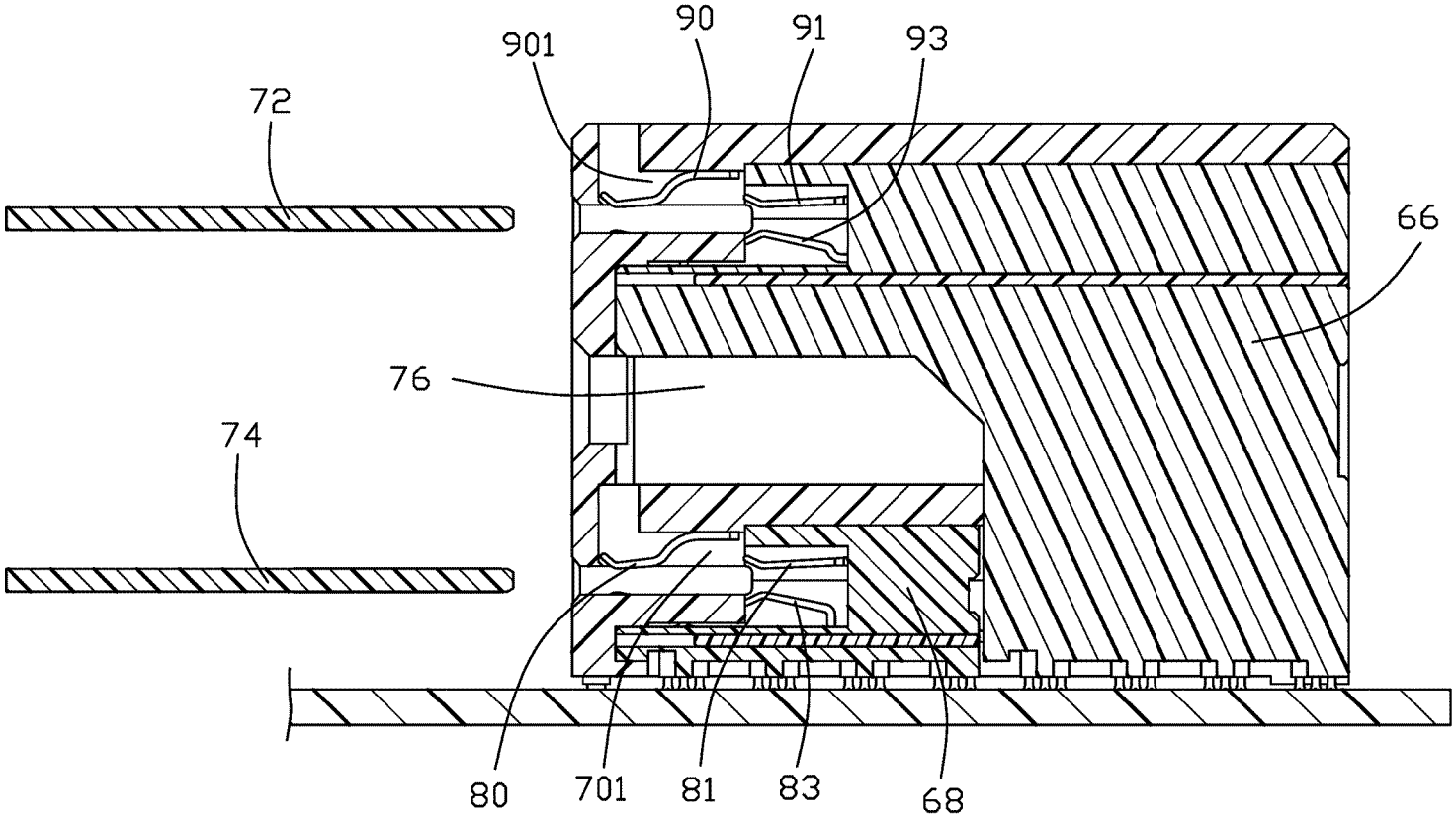
FIG. 16 is another cross-sectional view of the receptacle connector of FIG. 9 wherein the printed circuit boards are ready to be mated therewith.
Figure 17:
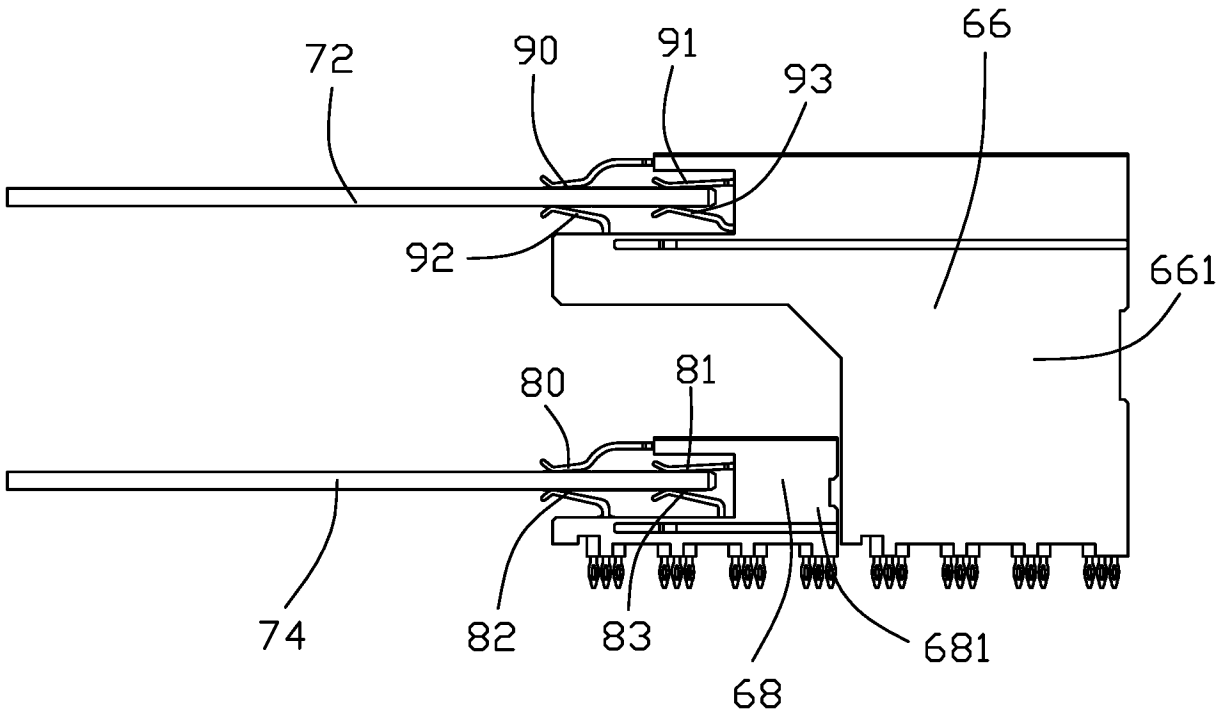
FIG. 17 is a side view of the receptacle connector of FIG. 1 wherein the printed circuit boards are mated therewith.

Reference will now be made in detail to the preferred embodiment of the present invention.

Referring to FIGS. 1-8, an electrical connector assembly 1 comprises an inner printed circuit board 500 of a plug connector (FIG. 20), and a receptacle connector 10 mounted upon an outer mother board 400. The receptacle connector 10 includes an insulative housing 12 defining a front mating port 14 and a rear connecting port 16. A plurality of upper passageways 18 and a plurality of lower passageways 20 with a receiving slot 22 therebetween in the vertical direction for receiving the printed circuit board 500, are formed in the front mating port 14. The insulative housing 12 comprises a pair of side walls 120, at least one of the side walls 120 defining an engagement groove 121 with a recession 122 in an inner side. An IMLA (Insert Molded Lead-Frame Assembly) 24 is received within a space (not labeled) in the rear connecting port 16.

The IMLA 24 includes a plurality of wafers 26 stacked with one another in the transverse direction. Each of the wafers 26 includes an insulator 28 with four contacts embedded therein and including a front upper contact 30, a rear upper contact 32, a front lower contact 34 and a rear lower contact 36 wherein both the front upper contact 30 disposed in the corresponding upper passageway 18 and the rear upper contact 32 exposed behind the upper passageway 18 are mated with the pads on the upper surface of the printed circuit board 500 while both the front lower contact 34 disposed in the corresponding lower passageway 20 and the rear lower contact 36 exposed behind the upper passageway 18 are mated with the pads on the bottom surface of the printed circuit board 500. Modular IMLA 24 can easily design as any numbers for different types of receptacle connector 10.

To enhance the engagement between the two neighboring wafers 26, the insulator 28 includes an engagement rib 38 with an embossment 40 thereon on one side face and an engagement groove 42 with a recession 44 in the other side face so as to assure no relative movement in a vertical plane between the two neighboring wafers 26. The engagement rib 38 and the embossment 40 of the outermost insulator 28 mated with the engagement groove 121 and the recession 122 of the insulative housing 12. To reinforce the engagement between the IMLA 24 and the housing 12, the IMLA 24 includes a protruding structure 46 received within a recess 48 in the front mating port 14 of the housing 12 for retaining the IMLA 24 in position in the housing 12 in the vertical direction. It should be noted that the upper passageways 18 and the corresponding lower passageways 20 are not aligned with each other in the vertical direction but being offset from each other in a transverse direction. Therefore, the corresponding front upper contact 30 and the rear upper contact 32 are equipped with a jogged structure 303 to be offset from the corresponding front lower contact 34 and rear lower contact 36 in the transverse direction.

It should be understood that on one hand, the front upper/lower contacts 30/34 are used with Legacy QSFP 28 interface while the front upper/lower contacts 30/34 and the rear upper/lower contacts 32/36 are used with QSFP-DD interface; on the other hand, the front upper contact 30 and the corresponding rear upper contact 32 are aligned with each other in the front-to-back direction, and the front lower contact 34 and the correspond lower contact 36 are as well.

Each of the contacts 30, 32, 34, 36 comprises a tail 300 for being mounted on the mother board 400, a resilient mating portion or contacting section 301 for being mating with the inner printed circuit board 500, and a body portion 302 connected therebetween. The jogged structure 303 is connected between the mating portion 301 and the body portion 302 of each of the front upper contacts 30 and the rear upper contacts 32. The tails are the compliant type, or the needle eye type, or the surface mount technology type. The tails of different row of the front upper/lower contacts 30/34 and the rear upper/lower contacts 32/36 may be selected as different types. The tails 300 of each of the wafers 26 are aligned in a line. Each of the tails 300 of one of the wafers 26 is offset with the corresponding one of the tail 300 of adjacent wafer 26 along the front-to-back direction.

FIGS. 9-17 disclose the double-deck receptacle connector 60 similar to the single-deck receptacle connector 10 except the insulative housing 70 defines a front upper mating port 62 for mating with an upper inner printed circuit board 72, a front lower mating port 64 for mating with lower inner printed circuit board 74, a space 76 opening at a front of the insulative housing 70 and between the front upper mating port 62 and the front lower mating port 64 in the vertical direction, and an upper IMLA 66 and a lower IMLA 68 assembled within the insulative housing 70 for mating with the upper inner printed circuit board 72 and the lower inner printed circuit board 74, respectively. The space 76 is in communication with the rear connecting port 61 for heat dissipation.

The lower IMLA 68 is same as the IMLA 24 of the single-deck receptacle connector 10. The lower IMLA 68 is first assembled into the lower portion of the insulative housing 70 from the rear connecting port 61 and the upper IMLA 66 is successively assembled into the upper portion of the insulative housing 70 also from the rear connecting port 61. The upper IMLA 66 is stacked with the lower IMLA 68. The lower IMLA 68 comprises a plurality of lower wafers 680 stacked with one another along the transverse direction. Each of said lower wafers comprises a lower insulator 681 equipped with a front upper contact 80 disposed in the corresponding upper passageway 701 of the lower mating port 64, a rear upper contact 81 located behind the corresponding upper passageway 701, a front lower contact 82 disposed in the corresponding lower passageway 702 of the lower mating port 64, and a rear lower contact 83 located behind the corresponding lower passageway 64. The upper IMLA 66 comprises a plurality of upper wafers 660 stacked with one another along the transverse direction. Each of said upper wafers 660 including an upper insulator 661 equipped with a front upper contact 90 disposed in the corresponding upper passageway 901 of the upper mating port 62, a rear upper contact 91 located behind the corresponding upper passageway 901, a front lower contact 92 disposed in the corresponding lower passageway 902 of the lower mating port 62, and a rear lower contact 93 located behind the corresponding lower passageway 902.

Each of the front upper/lower contacts 80, 82, 90, 92 and rear upper/lower contacts 81, 83, 91, 93 of the lower IMLA 68 and the upper IMLA 66 comprises a tail 800, a mating portion 801, and a body portion 802 connected therebetween. Each of the front upper contacts 80, 90 and the rear upper contacts 81, 91 of the lower IMLA 68 and the upper IMAL 66 further are equipped with a jogged structure 803 connected between the mating portion 801 and the body portion 802 that make the mating portions 801 of the front upper contact 80, 90 and the rear upper contacts 81, 91 to be offset from the mating portions 801 of corresponding front lower contact 82, 92 and rear lower contact 83, 93 in the transverse direction. The mating portions 801 of the front upper contact 90 and the rear upper contact 91 of one of the upper spacers 660 and the mating portions 801 of the front upper contact 80 and the rear upper contact 81 of corresponding one lower spacer 680 are disposed at a same vertical plane, and the mating portions 801 of the front lower contact 92 and the rear lower contact 93 of one of the upper spacers 660 and the mating portions 801 of the front lower contact 82 and the rear lower contact 83 of corresponding one lower spacer 680 are disposed at another same vertical plane. The body portions 802 and the tails 800 of the front upper contact 90, 80, the rear upper contact 91, 81, the front lower contacts 92, 82, and the rear lower contact 93, 83 of the upper and the lower spacers 660, 680 are disposed at the another same vertical plane.

Figure 18:
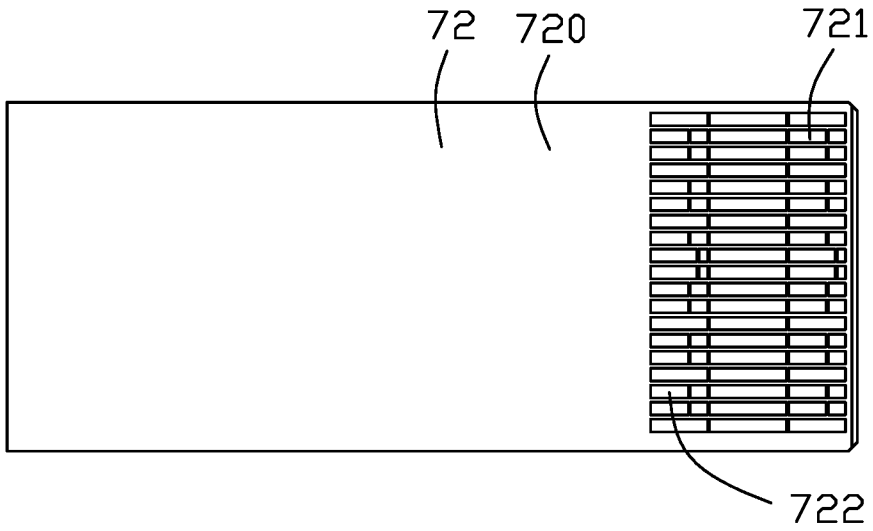
FIG. 18 is one surface of one of the inner printed circuit boards of FIG. 9.
Figure 19:
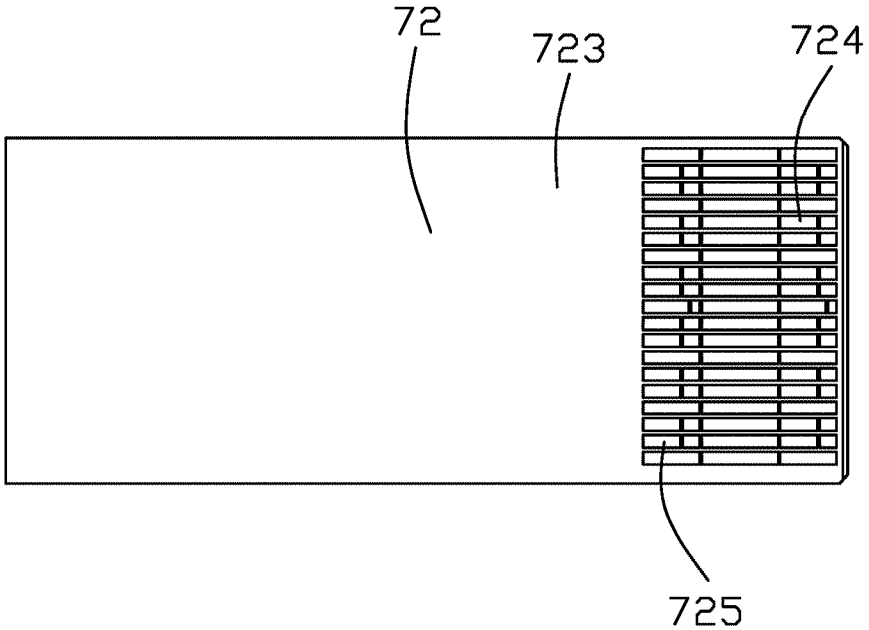
FIG. 19 is the other surface of one of the inner printed circuit board of FIG. 9.
Figure 20:
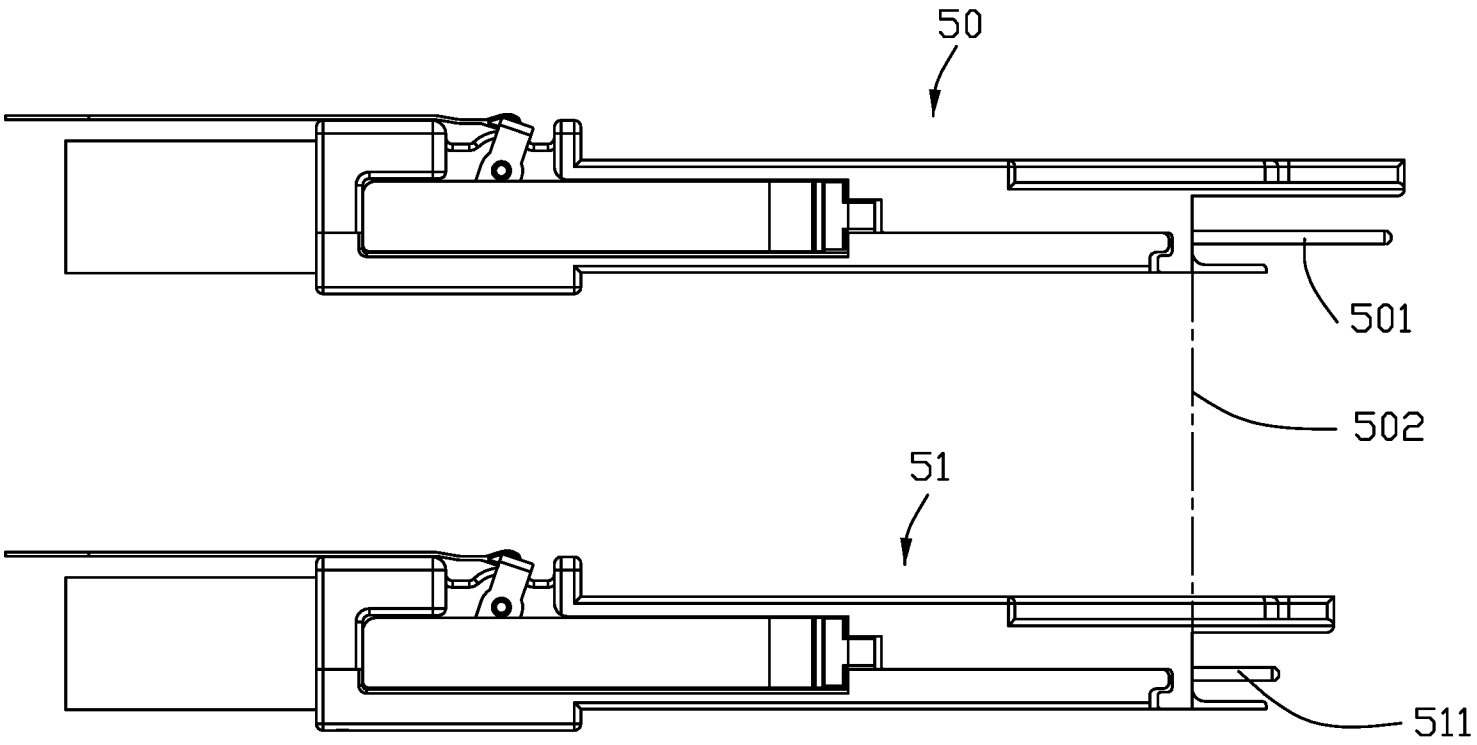
FIG. 20 is a side view of two types of plug connector in accordance with present invention.
Figure 21:
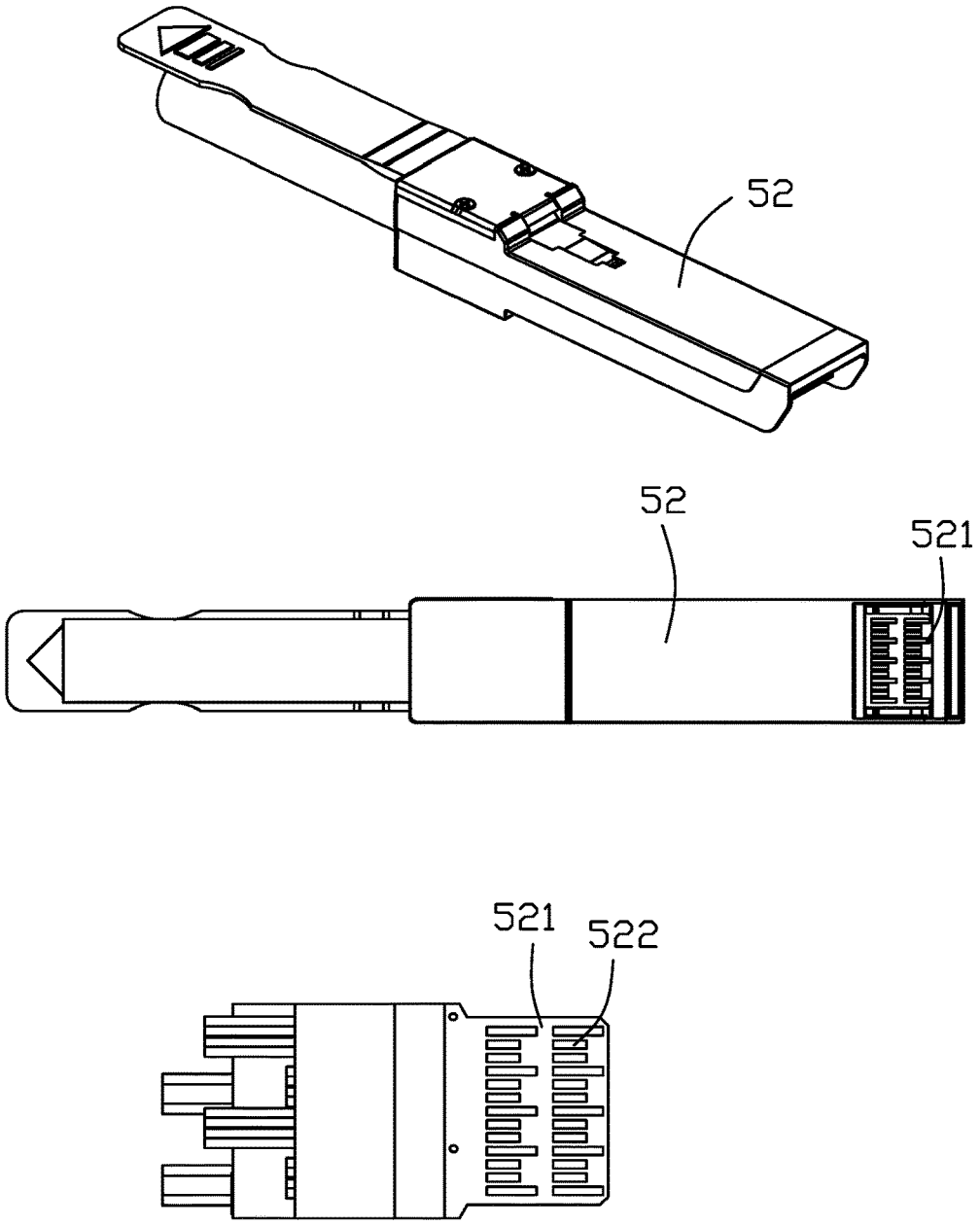
FIG. 21 is a perspective view of another embodiment of the plug connector in accordance with present invention.

FIGS. 18-19 illustrate the upper inner printed circuit board 72. The upper inner circuit board 72 comprises a top surface 720, a row of front upper pads 721 disposed at a front side of the top surface 720, a row of rear upper pads 722 disposed at a rear side of the front upper pads 721, a bottom surface 723 opposite to the top surface, a row of front bottom pads 724 disposed at a front side of the bottom surface 723, and a row of rear bottom pads 725 disposed at a rear side of the front bottom pads 724. The front upper pads 721 are jogged with the front bottom pads 724, respectively. The rear upper pads 722 are also jogged with the rear bottom pads 725, respectively. The lower inner printed circuit board 74 and the inner printed circuit board 500 are same as the upper inner printed circuit board 72. FIG. 20 illustrates two types of plug 50, 51 which could mate with the single-deck receptacle connector 10 or the double-deck receptacle connector 60. In this embodiment, the difference between the two types of plug 50, 51 is the upper plug 50 is QSFP DD plug which has an inner printed circuit board 501 same as the upper inner printed circuit board 72, and the bottom plug 51 is QSFP plug or QSFP 28 plug which has an inner printed circuit board 511 shorter than the inner printed circuit board 501 and only having one row pads (not shown) in top and bottom surfaces. The upper plug 50 mates with all of the contacts of the single-deck receptacle connector 10 or the double-deck receptacle connector 60. The bottom plug 51 and the upper plug 50 have a common front stopper 502. Therefore, the bottom plug 51 only mates with the front upper contacts 80, 90 and front lower contacts 82, 92 of the single-deck receptacle connector 10 or the double-deck receptacle connector 60. FIG. 21 illustrates another type of the plug 52 which has a different interface and pad numbers compared with the upper plug 50. FIG. 21 illustrate another type of the plug 52 has different interface and pad 522 numbers compared with the upper plug 50.

What is claimed is:

1. A receptacle connector for two different type plugs comprising:

an insulative housing defining a front mating port and a rear connecting port along the front-to-back direction, the front mating port defining a plurality of upper passageways and a plurality of lower passageways with a receiving slot therebetween in the vertical direction perpendicular to said front-to-back direction, the upper passageways being respectively offset from the corresponding lower passageways in a transverse direction perpendicular to both said front-to-back direction and said vertical direction;

an IMLA (Insert Molded Lead-Frame Assembly) assembled within a space of the rear connecting port and including a plurality of wafers stacked with one another along the transverse direction, each of said wafers including an insulator equipped with a front upper contact disposed in the corresponding upper passageway, a rear upper contact located behind the corresponding upper passageway, a front lower contact disposed in the corresponding lower passageway, and a rear lower contact located behind the corresponding lower passageway; wherein on one hand, the front upper contacts and the front lower contacts are mated with one of the two type plugs when said one of the two different type plugs is inserted into the receiving slot; on the other hand, all the front upper contacts, the front lower contacts, the rear upper contacts and the rear lower contacts are mated with the other of said two different type plugs when said other of said two different type plugs is received within the receiving slot.

2. The receptacle connector as claimed in claim 1, wherein each of the insulators comprises an engagement rib with an embossment in one side, and a engagement groove with a recession in an opposite side, the engagement rib and the embossment of one insulator mated with the engagement groove and the recession of adjacent insulator.

3. The receptacle connector as claimed in claim 2, wherein the insulative housing comprises a pair of side walls, at least one of the side walls defining an engagement groove with a recession in an inner side, and the corresponding one of the outermost insulator of the IMLA comprises an engagement rib with an embossment mated with the engagement groove and the recession.

4. The receptacle connector as claimed in claim 1, wherein the IMLA comprises a protruding structure received within a recess in the front mating port of the housing for retaining the IMLA in position in the housing in the vertical direction.

5. The receptacle connector as claimed in claim 1, wherein each of the front upper contacts and the rear upper contacts is equipped with a jogged structure to be offset from the corresponding front lower contact and rear lower contact in the transverse direction.

6. The receptacle connector as claimed in claim 5, wherein the front upper contact and the corresponding rear upper contact of each wafers are aligned with each other in the front-to-back direction, and the front lower contact and the correspond lower contact of each wafers are as well.

7. The receptacle connector as claimed in claim 1, wherein each of the contacts comprises a tail, the tails of each of the wafers aligned in a line.

8. The receptacle connector as claimed in claim 1, wherein each of the tails of one of the wafers is offset with the corresponding one of the tail of adjacent wafer along the front-to-back direction.

9. A double-deck receptacle connector, comprising:

an insulative housing defining a front upper mating port, a front lower mating port, and a rear connecting port along the front-to-back direction, both of the front upper mating port and the front lower mating port defining a plurality of upper passageways and a plurality of lower passageways with a receiving slot therebetween in the vertical direction perpendicular to said front-to-back direction, the upper passageways being respectively offset from the corresponding lower passageways in a transverse direction perpendicular to both said front-to-back direction and said vertical direction;

a lower IMLA (Insert Molded Lead-Frame Assembly) assembled within the rear connecting port and including a plurality of lower wafers stacked with one another along the transverse direction, each of said lower wafers including a lower insulator equipped with a front upper contact disposed in the corresponding upper passageway of the lower mating port, a rear upper contact located behind the corresponding upper passageway, a front lower contact disposed in the corresponding lower passageway of the lower mating port, and a rear lower contact located behind the corresponding lower passageway;

an upper IMLA assembled within the rear connecting port and stacked with the lower IMLA, the upper lower IMLA including a plurality of upper wafers stacked with one another along the transverse direction, each of said upper wafers including an upper insulator equipped with a front upper contact disposed in the corresponding upper passageway of the upper mating port, a rear upper contact located behind the corresponding upper passageway, a front lower contact disposed in the corresponding lower passageway of the lower mating port, and a rear lower contact located behind the corresponding lower passageway.

10. The double-deck receptacle connector as claimed in claim 9, wherein the insulative housing defines a space opening at a front of the insulative housing and between the front upper mating port and the front lower mating port.

11. The double-deck receptacle connector as claimed in claim 10, wherein the space is in communication with the rear connecting port.

12. The double-deck receptacle connector as claimed in claim 9, wherein each of the front upper/lower contacts and rear upper/lower contacts of the lower IMLA and the upper IMLA comprises a tail, a mating portion, and a body portion connected therebetween, each of the front upper contacts and the rear upper contacts of the lower IMLA and the upper IMAL further equipped with a jogged structure connected between the mating portion and the body portion that make the mating portions of the front upper contact and the rear upper contacts to be offset from the mating portions of corresponding front lower contact and rear lower contact in the transverse direction.

13. The double-deck receptacle connector as claimed in claim 12, wherein the mating portions of the front upper contact and the rear upper contact of one of the upper spacers and the mating portions of the front upper contact and the rear upper contact of corresponding one lower spacer are disposed at a same vertical plane, and the mating portions of the front lower contact and the rear lower contact of one of the upper spacers and the mating portions of the front lower contact and the rear lower contact of corresponding one lower spacer are disposed at another same vertical plane.

14. The double-deck receptacle connector as claimed in claim 13, wherein the body portions and the tails of the front upper contact, the rear upper contact, the front lower contacts, and the rear lower contact of the upper and the lower spacers are disposed at the another same vertical plane.

15. A receptacle connector comprising:

an insulative housing defining a front mating port and a rear connecting port along the front-to-back direction, the front mating port defining a plurality of upper passageways and a plurality of lower passageways with a receiving slot therebetween in the vertical direction perpendicular to said front-to-back direction, the upper passageways being respectively offset from the corresponding lower passageways in a transverse direction perpendicular to both said front-to-back direction and said vertical direction;

an IMLA (Insert Molded Lead-Frame Assembly) assembled within a space of the rear connecting port and including a plurality of wafers stacked with one another along the transverse direction, each of said wafers including an insulator equipped with a front upper contact disposed in the corresponding upper passageway, a rear upper contact, a front lower contact disposed in the corresponding lower passageway, and a rear lower contact; wherein in each wafer, both said front upper contact and the rear upper contact have corresponding resilient contacting sections at a first vertical plane while both said front lower contact and said rear lower contact have corresponding resilient contacting sections at a second vertical plane spaced from the first vertical plane in the transverse direction.

16. The receptacle connector as claimed in claim 15, wherein in each wafer, tail sections of all the front upper contact, the front lower contact, the rear upper contact and the rear lower contact are located in a same vertical plane.

17. The receptacle connector as claimed in claim 16, wherein said same vertical plane is the second vertical plane.

18. The receptacle connector as claimed in claim 15, wherein said receiving slot extends rearwardly along the front-to-back direction into the housing beyond the upper passageways so that each of the rear upper contacting sections is not received within the corresponding upper passageway but located behind the corresponding upper passageway.

19. The receptacle connector as claimed in claim 15, wherein said receiving slot extends rearwardly along the front-to-back direction into the housing beyond the lower passageways so that each of the rear lower contacting sections is not received within the corresponding lower passageway but located behind the corresponding lower passageway.

20. The receptacle connector as claimed in claim 15, wherein in each wafer, the resilient contacting sections of both the front upper contact and the rear upper contact extend forwardly away from a forward face of the insulator in said front-to-back direction, while the resilient contacting sections of both the front lower contact and the rear lower contact extend upwardly from an upward faceoff the insulator in the vertical direction.

* * * * *